United States Patent [19]

Knoess

[11] Patent Number: 5,016,348

[45] Date of Patent: May 21, 1991

[54] PROCESS FOR THE MANUFACTURE OF A TUBULAR CRANKSHAFT

[75] Inventor: Walter Knoess, Fuessen-Weissensee, Fed. Rep. of Germany

[73] Assignee: Sinterstahl Gesellschaft m.b.H., Fussen, Fed. Rep. of Germany

[21] Appl. No.: 418,123

[22] Filed: Oct. 6, 1989

[30] Foreign Application Priority Data

Oct. 10, 1988 [DE] Fed. Rep. of Germany ..... 3834401

[51] Int. Cl.[5] ..... B23P 15/00

[52] U.S. Cl. ..... 29/888.1; 29/527.3

[58] Field of Search ..... 29/527.1, 527.3, 888.1

[56] References Cited

U.S. PATENT DOCUMENTS

| | | | |
|---|---|---|---|
| 4,094,053 | 6/1978 | Weaver . | |
| 4,616,389 | 10/1986 | Slee | 29/559 X |
| 4,781,076 | 11/1988 | Hartnett et al. | 29/523 X |
| 4,858,295 | 8/1989 | Hartnett et al. | 29/523 X |
| 4,908,923 | 3/1990 | Anderson et al. | 29/527.5 X |

FOREIGN PATENT DOCUMENTS

| | | |
|---|---|---|
| 2336241 | 2/1975 | Fed. Rep. of Germany . |
| 2232438 | 12/1977 | Fed. Rep. of Germany . |
| 2657479 | 4/1979 | Fed. Rep. of Germany . |
| 3431361 | 3/1986 | Fed. Rep. of Germany . |
| 62-51704 | 8/1987 | Japan . |
| 63-12809 | 6/1988 | Japan . |
| 0170378 | 6/1985 | United Kingdom . |
| 2153850 | 8/1985 | United Kingdom . |

*Primary Examiner*—Timothy V. Eley

*Attorney, Agent, or Firm*—Morgan & Finnegan

[57] ABSTRACT

The invention relates to a process for the manufacture of a tubular camshaft in accordance with which process individual cams are subsequently attached to a prefabricated tubular shaft. Such processes acquire ever increasing importance in view of the multivalve technology utilized in automobile construction vis-a-vis processes still predominantly in use today employing casting and subsequent lathing and grinding of camshafts. In accordance with the invention, powdery cam material is directly compressed onto the prefabricated tubular shaft and sintered. With this process, utilization of a single-use compression jacket mold is critical, which jacket mold is preferably manufactured according to the synthetic blow mold process. In addition to its economical nature, this process provides the advantages of enabling greater design flexibility with respect to molding and selection of materials to be used.

15 Claims, No Drawings

PROCESS FOR THE MANUFACTURE OF A TUBULAR CRANKSHAFT

BACKGROUND AND OBJECTS OF THE INVENTION

1. Field of the Invention

The present invention relates to a process for the manufacture of a tubular camshaft, useful, e.g., for an internal combustion engine. In accordance with the process individual cams are attached to a prefabricated tubular shaft.

2. Description of the Prior Art

Camshafts are usually solidly cast; the cams themselves are then worked to specified dimensions through lathing and grinding. In recent years, in response to multivalve technology, light-weight, concave camshafts have been needed. These camshafts promote one-shot lubrication and reduce material costs. The first practical attempts at fabricating camshafts from individual segments have recently been made. This fabrication involves assembling individual tubular shaft segments together with prefinished cams to form the entire shaft, or provides for attaching individual cams to a single-piece corrugated tube and connecting the cams thereto by cementing, soldering or mechanical means. Many processes which provide for connecting the concave-shaped shaft and prefabricated cams and, if required, bearing elements have been previously described in the art.

The most common of these processes include

Shrink fitting the cams onto the tubular shaft,

Threading the cams onto the shaft and subsequently expanding the tube by suitable compressive means, for example, by an explosion-like high-speed deformation (DE-AS 22 32 438), Thermal expansion with concurrent upsetting of the tube by clamping jaws attached to the ends (DE-OS 34 31 361), and Combined shrink-fitting of the cams and elastic expansion of the tubular shaft (DE-AS 26 57 479).

Among other methods, a specific process previously disclosed (DE-OS 34 31 361) involves attaching the cams to the shaft by soldering in conjunction with tube expansion. According to this method, in order to bolster the clamping effect and to achieve an extremely rigid solder connection, the cams are provided on their interior peripheral area with a notched gear-and-tooth configuration.

Such techniques are becoming more and more significant because the automobile industry, owing to heightened emission control limitations, is introducing more engines having four or more valves per cylinder, which means that the number of cams per shaft or per engine is thereby commensurately increased. Even today, cast camshafts, finished by means of lathing and grinding, are produced more economically than camshafts with cams that have been threaded on or otherwise mounted. The new technique of the assembled camshaft, however, provides substantial advantages with respect to the practical further development of the camshaft-regulated internal combustion engine. This technique also offers benefits with respect to the choice of materials for and molding of the camshaft.

A formcast camshaft consists of a uniform material. Cams exposed to particular wear and tear frequently undergo additional surface processing and treatment, receiving a particularly abrasion-resistant protective surface coating. In contrast to this, tubular shafts bearing mounted cams can be constructed using different materials for both parts (DE-OS 23 36 241).

The aforementioned patent disclosure specifies, for example, the use of sintered, sinter-forged, cast, extruded, stamped or even lathed and milled parts for the cams attached to the tubular shaft. It proposes solidly attaching these cams to the shaft by means of cementing, welding, brazing, shrinking or expanding.

A drawback inherent in all the processes described hereinbefore is that the subsequent attachment of cams to a shaft is difficult due to both the great technical expense and time implicit in the preparatory treatment of the cams and in their exact positioning on and joining to the shaft. The process coordination involved in expansion or shrink-fitting with respect to the materials of choice used in the tubular shaft and in the cams has also not been fully resolved from a technical standpoint. This selection of materials entails substantial compromise.

Finally, expansion of the tubular shaft results, as a rule, in the flowing of materials and, consequently, in forming varyingwall thicknesses in partial sections of the tubular shaft. Allowance must be made for these irregularities when dimensioning the tubular walls. That is, in order to assure satisfactory physical properties, relatively thick-walled tubes must be used. This, however, runs counter to the need to develop the lightest possible camshafts for fuel-efficient internal combustion engines.

OBJECTS OF THE INVENTION

An object of the present invention is, in view of the foregoing, to develop a process for the manufacture of a tubular camshaft which, vis-a-vis the state of the art, is less complicated from an engineering standpoint and therefore more economical and which process employs a prefabricated tubular shaft onto which shaft cams and, if required, other bearing and wearing parts are subsequently attached.

Another object of this invention is to provide a process which enables the fabrication of extremely light-weight camshafts whose shafts are characterized by very thin walls.

Yet another object of the invention is to provide a new camshaft product and to broaden the range of materials which can be used in making the shaft and cams so as to be able to maximize the requisite and, in individual areas of the camshaft, varying mechanical properties and wearing properties, without having to compromise in the selection of such materials owing to the limitations heretofore imposed thereon by the present state of the art.

SUMMARY OF THE INVENTION

These and other objects are accomplished by the present invention by having the cam material compressed in powder form onto the prefabricated tubular shaft and sintered. The shaft and the cam material are placed in a single-use compression molding jacket and isostatically compressed in this arrangement by means of a compression medium. The compression medium has unobstructed access to the inside of the tube during the compression operation.

The process according to the invention is principally used to manufacture metal camshafts but is not restricted to these constructions. Hard metals, metal powder-base or even pure non-metallic materials may be used to manufacture the cams.

By using well-known methods already taught by the art, it is also possible to first place a material A into the compression molding jacket in the area of the cams in the form of a comparatively thin layer and to then fill up the cam area of the compression molding jacket with a powdery material B. Material A can, for example, be injected into the compression mold in a mixture together with a bonding agent which can be subsequently evaporated off or it can be placed in the form of metal cloths, that is, in the form of a mixture of abrasion-resistant material and an elastic, evaporable bonding material.

DETAILED DESCRIPTION OF THE INVENTION

Today, the synthetics blow mold process is a widely used, economical process wherein a variety of synthetics, especially polyethylene, can be extruded into a tubular blank mold. These synthetics, while still in an unhardened state, are compressed against a form tool wall by means of compressed air and hardened. Care must be taken, of course, to choose the proper synthetics for the compression molding jacket so that the synthetics have sufficient elasticity and strength for the powder compression molding operation. Those compression mold processes finding widespread utilization in powder metallurgy applications are performed at compressive molding pressures of between about 500 and 4000 bar. The compressive medium is principally water. That results in a medium compressive shrinkage of the powder material poured into the jacket and which, as a result of shaking, is slightly precompressed, on an order of magnitude of between about 15–20%.

When designing and dimensioning the jacket mold, adequate attention must paid to the fact that the cam blanks compressed onto the prefabricated shaft shrink about 15–20% in volume during the subsequent sintering. The compression molding jacket must also be dimensioned in such a way that the jacket rests in form-locking manner outside the cam areas on the tubular shaft, thereby eliminating any undesirable eccentricity of the camshaft.

In order to ensure, for purposes of the compression operation, that the compression jacket rests compactly on the external surface area of the shaft at its ends and that, at the same time, the compression medium has unobstructed access to the interior for the tubular shaft, the compression jacket is preferably mechanically clamped to the shaft surface in the area of the shaft ends by means of a metal sleeve.

The unobstructed access of the compression medium to the interior of the tube during the compression operation is desirable, on the one hand, so as not to deform the comparatively thin-walled corrugated tube at the high compressive loads generated during the compressing process. It is also desirable so as to ensure that the compressing of the cam material onto the prefabricated shaft is, from the compressive molding engineering standpoint, accomplished by a unilateral pressing on and compressing action. That facilitates an adequately uniform compression of the powder and makes it easier to maintain the desired dimensions of the blank.

The end areas of the prefabricated tubular shaft, that is, the sections between the end of the shaft and first cam, must be long enough to effect a powder-tight seal between the compression jacket and the surface area of the shaft. It may therefore prove necessary to shorten the initially overdimensioned tubular shaft following the compression operation.

Alternatively, or in addition thereto, following the compression operation of the invention the shaft ends, separately compressed to blanks of any desired shape, can be slid onto or into the shaft and, in a common sintering process, sintered together with the cams onto the shaft and, via diffusion jointing, connected in material-locking manner to the shaft.

According to a special execution of the process pursuant to the invention, a prefabricated tubular shaft made of a comparatively ductile and fusible material, for example, copper, is used and the single-use compression jacket shaped and dimensioned in such a way that powdery cam material is compressed onto the shaft, forming a layer in the area between individual cams, and then sintered.

As a rule, the bending strength of the camshaft in the "double-walled tube" manufactured in this manner is determined by the external wall. In this case, the shaft, during isostatic compressing, is expediently protected against distortion by inserting, during said procedural step, a perforated steel pipe at least by sections, in register, into the prefabricated tubular shaft. The perforation allows the compression medium to reach the inner tube surface area of the prefabricated shaft.

The process according to the invention allows a "near net shape" to be realized, that is, a camshaft prefabricated in this manner, following sintering, only has to be worked in a final grinding process to the required surface finish quality and to the final dimensions within permitted dimensional tolerances.

According to the term "single-use compression molding jacket" used hereinbefore, the synthetic compression molding jacket is stripped from or burned off the compressed blank following the compression operation and is not reusable. The subsequent sintering operation is carried out using processses known in the art. To minimize sintering deformation and still operate on an economical basis, the camshafts are preferably sintered in a vertical, hanging position In exceptional instances, post-treatment of materials after sintering may be neccessary in order to restore those mechanical properties of the shaft material which were lost during sintering.

The prefabricated tubular shaft is preferably cylindrical in shape. It may, however, have a cross-section in the shape of a multiangular polygon.

The prefabricated tubular shaft, prior to the compressing on of the powder material, is expediently pretreated in accordance with well-known methods to thereby faciliate, by means of diffusion jointing, the sintering of the compressed cam material onto the shaft material. Such measures include, for example, sandblasting or phosphatizing the surface area.

Mechanical stresses between the various materials used for the cams and the tubular shaft can result in fissures and, in extreme cases, in the cams detaching from the shaft. To reduce these mechanical stresses, it may prove advantageous to form an intermediate layer made of a third material. The material for the intermediate layer should have inherent shrinkage characteristics and a thermal expansion coefficient both of which lie between that of the material used for the cams and that of the shaft or it should possess in and of itself high ductility and fusible properties. Such intermediate layers can, for example, be sprayed, applied or slid in register as a molded lamella onto partial areas of the prefabricated shaft prior to the shaft's insertion into the compression mold jacket.

The substantive advantage of the present inventive process vis-a-vis processes known in the art for the manufacture of tubular camshafts utilizing a prefabricated corrugated tube lies in its economical manufacture affording, in contrast to the state of the art, a practically unlimited selection of materials. The economical advantage of the inventive process results from the fact that single-use compression mold jackets can be cost-effectively fabricated and yet this process allows the jackets to be formed with great dimensional consistency and high quality control by using the synthetics blow mold process. Moreover, "near net shape" cams can, in accordance with this process, be sintered onto the tubular shaft, which cams subsequently need only a comparatively cost-effective grinding operation to put them in application-ready condition. Manufacturing camshafts using the invention and their post-treatment to make these camshafts ready for use is more economical than manufacturing camshafts by casting, shaping, using a machine tool which removes chips, and then grinding.

The materials engineering and practical design possibilities inherent in camshafts made using the process of the present invention are more diverse than those available using those processes known in the art.

The invention is described in even greater detail in the following examples

EXAMPLE 1

In the manufacture of the cams for a camshaft, an alloying powder, consisting of 5% by weight of chromium, 1% by weight of silicon, 0.5% by weight of manganese, 0.5% by weight of phosphorous, 0.15% by weight of carbon, the remainder, iron, was thoroughly mixed with 2.4% of graphite and poured into a single-use compression mold jacket in a camshaft mold. Thereupon, the prefabricated tubular shaft, temporarily sealed by a cap placed on it, was introduced from below into the compression jacket mold filled with power and, through shaking, moved upward. The amount of powder, filled to excess, was forced out toward the top. In this manner, a predensification of the powder in the compression jacket mold was acquired. The compression jacket mold was thereupon sealed at both ends by mechanically interlockable sleeves clamped onto the ends of the tubular shaft, leaving the tube ends open. Then, at a pressure of 2500 bar, the assembly was isostatically compressed in a cold-isostatic press using water as the compression medium.

Following compression, the mold was burned off in the buffer gas flow in the preheating area of a sintering oven. The single-use compression jacket mold, being made of polyethylene, decomposed almost without residue, being consumed by fire. Next, the camshaft, which was removed from the compression jacket mold, was provided at both ends, respectively, with a premolded plug of pressed powder and, by means of appropriate mounting supports, placed in vertical position into the sintering oven. Sintering using buffer gas was carried out at a temperature of 1080° C. for 60 minutes. In the process, the compressed alloying powder formed a metallic connection with the tubing material The hardness of the sintered cams was between 52–54 HRC.

By using methods known in the art enabling fabrication of the camshaft through sintering to only slightly oversize dimensions, (near net shape), the camshaft was economically finished through grinding alone.

EXAMPLE 2

A prefabricated tubular shaft made of copper or a low-alloy content, comparably ductile and fusible copper alloy is slid, in register, onto a perforated high-strength steel tube for the isostatic compressing operation to manufacture the camshaft.

Powder of an abrasion-resistant steel alloy to which serves as the cam material is introduced into the single-use compression jacket mold. Thereupon, the compound, perforated steel tube and copper shaft are inserted into one of either orifices in the compression jacket mold and, through shaking and compaction of the powder, forced through the jacket mold.

The interior dimensions of the compression jacket mold are designed so that the jacket mold, after the tubular shaft has been inserted at both ends, sits on this shaft in register, while in the remaining areas outside the cam an intermediate space filled with powder is maintained between the tubular shaft and the wall of the compression jacket mold. Alternatively, the compression jacket mold sits in register over sufficient length on the ends projecting out of the copper tube of the steel tube which is not perforated at this position.

The ends of the compression jacket mold are clamped onto the surface of the tube by means of sleeves and are introduced into an isostatic press in such a way that the compression medium is able to penetrate into the interior of the tube, being able to act from this position by means of the perforated steel shaft on the tubular shaft made of copper. The powder material is thereby compressed both by means of the compression jacket mold and a slight expansion of the copper tube.

Following isostatic compression, the perforated steel tube is removed from the copper tube. This, as a rule, is accomplished effortlessly owing to the slight expansion of the copper tube during the isostatic compression operation.

The camshaft thus removed from the compression jacket mold, in a manner corresponding to the conditions set forth in Example 1, is thereupon sintered, albeit at approximately 100° C. lower temperatures.

The sintered camshafts are subsequently finished by means of mechanical grinding.

By virtue of this execution of the process, particularly good and elastic connections between the prefabricated tubular shaft and the sintered material can be effected. The results of materials testing have shown that during the course of the compression operation, fusible copper penetrates in a transition zone into the pores between the grains of powder and that this netting effect of materials is additionally intensified by interdiffusion during the ensuing sintering operation. In this manner, particularly solid and, at the same time, elastic connections between the prefabricated tubular shaft and the cam material can be realized. Camshafts manufactured according to this process do not display any fissuring tendencies.

The invention in its broader aspects is not limited to the specific embodiments herein shown and described but departures may be made therefrom within the scope of the accompanying claims, without departing from the principles of the invention and without sacrificing its chief advantages.

I claim:

1. A process for the manufacture of a tubular camshaft having a prefabricated tubular shaft and at least one cam, comprising the steps of:

providing said prefabricated tubular shafts having an interior;

providing a powdery cam material;

providing a compression molding jacket having an interior including a cam area;

placing said shaft and said cam material in said compression molding jacket;

isostatically compressing said shaft, cam material and jacket by means of a compression medium said compression medium having unobstructed access to the interior of the tube during the compression operation; and sintering said camshaft.

2. A process for the manufacture of a tubular camshaft according to claim 1, wherein said compression molding jacket is a synthetic jacket mold blown against a camshaft form tool wall using a synthetic blow mold process.

3. A process for the manufacture of a tubular camshaft according to claim 1 wherein said compressing of said powdery cam material onto said tubular shaft is accomplished by applying unilateral compressive loading.

4. A process for the manufacture of a tubular camshaft according to claim 1, wherein said tubular shaft and said cam material comprise metals.

5. A process for the manufacture of a tubular camshaft according to claim 1, wherein said cam material is a ceramic powder-base or metal powder-base material, said tubular shaft is metal, and said cam material is applied to said metal tubular shaft.

6. A process for the manufacture of a tubular camshaft according to claim 1, further comprising the step of placing various cam materials in layered fashion on top of each other in said interior area of said compression molding jacket.

7. A process for the manufacture of a tubular camshaft according to claim 1, wherein said step of compressing said cam material onto said tubular shaft comprises a single working operation.

8. A method for manufacturing a tubular camshaft, comprising the steps of:

inserting a cam material into a compression molding jacket;

inserting a prefabrication tubular shaft within said compression molding jacket;

sealing said compression molding jacket with said cam material and said tubular shaft therein;

isostatically compressing said compression molding jacket, said cam material and said tubular shaft;

removing said compression molding jacket; and sintering said cam material onto said tubular shaft.

9. A method of manufacturing a tubular camshaft as claimed in claim 8, wherein said compression molding jacket is single-use.

10. A method for manufacturing a tubular camshaft as claimed in claim 8, wherein said step of sealing said compression molding jacket comprises clamping said jacket onto the ends of said tubular shaft by means of a metal sleeve.

11. A method for manufacturing a tubular camshaft as claimed in claim 8, further comprising the step of forming an intermediate layer on at least a partial area of said tubular shaft prior to said insertion within said compression molding jacket.

12. A method for manufacturing a tubular camshaft as claimed in claim 8, further comprising the step of inserting a perforated tubular shaft into said prefabricated tubular shaft during said compression step.

13. A method for manufacturing a tubular camshaft as claimed in claim 8, wherein said compression molding jacket is removed by burning.

14. A method for manufacturing a tubular camshaft as claimed in claim 8, further comprising the step of applying a premolded plug of pressed powder onto both ends of said tubular shaft prior to said sintering.

15. A method for manufacturing a tubular camshaft as claimed in claim 8, further comprising the step of sealing said tubular shaft prior to said insertion within said compression molding jacket, said shaft being unsealed prior to said compression step.

* * * * *